United States Patent [19]

Bertiller et al.

[11] Patent Number: 4,633,755

[45] Date of Patent: Jan. 6, 1987

[54] GASTIGHT SEAL OF A GUN BARREL

[75] Inventors: Roland Bertiller; Gerd Kellner, both of Schramberg; Helmut Reudelsterz, Oberndorf, all of Fed. Rep. of Germany

[73] Assignee: Mauser-Werke Oberndorf GmbH, Fed. Rep. of Germany

[21] Appl. No.: 617,727

[22] Filed: Jun. 6, 1984

[30] Foreign Application Priority Data

Jun. 11, 1983 [DE] Fed. Rep. of Germany ..... 3321233

[51] Int. Cl.[4] ..... F41C 21/10; F41D 11/30

[52] U.S. Cl. ..... 89/29; 102/446

[58] Field of Search ..... 42/77; 89/26, 29; 102/444, 445, 446, 447

[56] References Cited

U.S. PATENT DOCUMENTS

| | | | |
|---|---|---|---|
| 976,459 | 11/1910 | Hartmann | 102/446 |
| 3,968,726 | 7/1976 | Grimm et al. | 89/26 |
| 4,404,765 | 9/1983 | Reudelsterz et al. | 42/77 |

FOREIGN PATENT DOCUMENTS 8009469 7/1981 Fed. Rep. of Germany .

*Primary Examiner*—Stephen C. Bentley

*Attorney, Agent, or Firm*—McGlew and Tuttle

[57] ABSTRACT

An arrangement for gastightly sealing the gap between the cartridge chamber and the bottom of an insert which is received in a gun barrel 1 to be able to fire cartridges of a smaller caliber. The gastightness is obtained substantially by providing that the neck of the subcaliber cartridge case inserted in the cartridge chamber protrudes into the bottom of the barrel insert and that the outer surface of the neck snugly fits the cylindrical surface of the insert.

2 Claims, 1 Drawing Figure

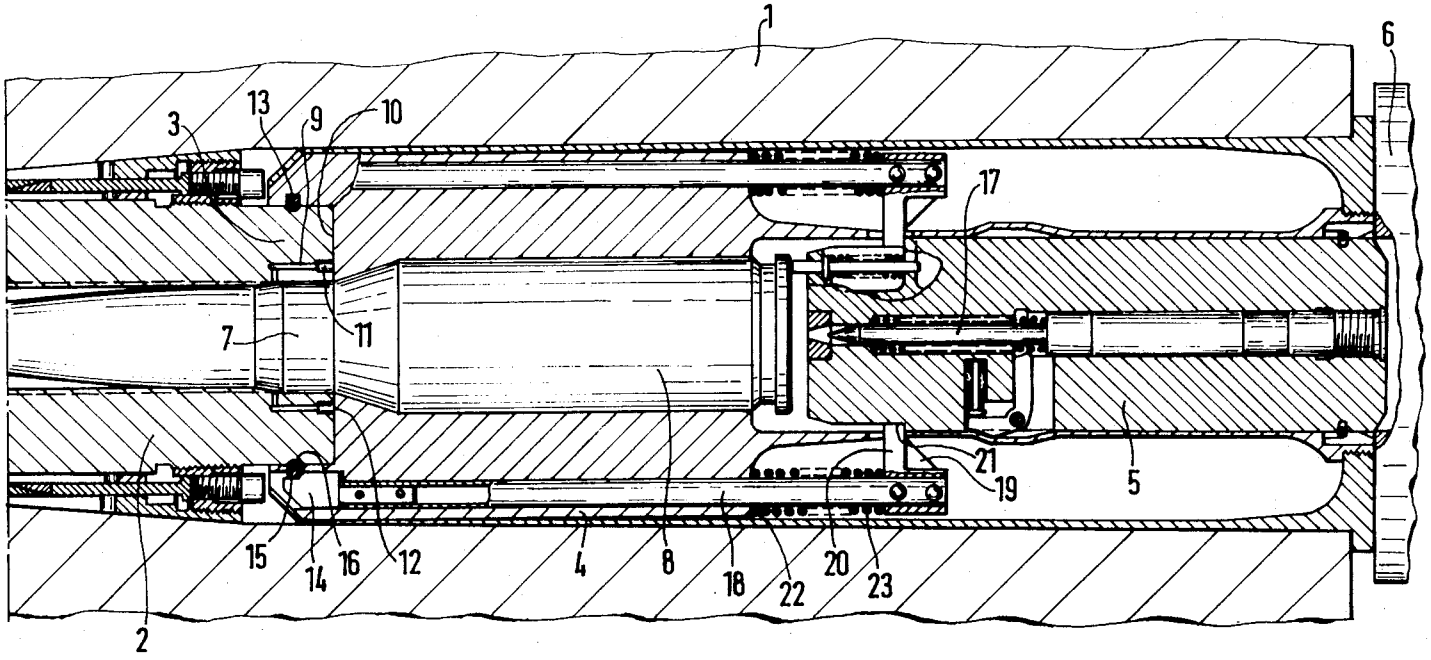
6
5
17
21
19
23
20
22
18
1
8
4
12
10
11
16
9
14
13
15
7
3
2

GASTIGHT SEAL OF A GUN BARREL

FIELD AND BACKGROUND OF THE INVENTION

This invention relates in general to the construction of weapons and in particular to a new and useful gastight seal of a gun barrel having an insert for firing a cartridge of a small caliber.

German utility model No. 80 09 469 (U.S. Pat. No. 4,404,765) discloses an arrangement for firing cartridges from a barrel having a larger caliber than the ammunition. Provided is a barrel insert which can be introduced into the barrel axially and locked radially, and has a tapering bottom portion which is to apply against a conformable opposite surface of the cartridge chamber. The cartridge chamber is axially fixed relative to the barrel insert by the breech block.

To operate a gun with a barrel insert safely, a gastight seal must be provided between the cartridge chamber and the bottom of the barrel insert.

SUMMARY OF THE INVENTION

The invention is directed to a gastight seal between the cartridge chamber and the opposite bottom of the barrel insert which would be inexpensive and safe.

In accordance with the invention, this is obtained by providing that at least the cylindrical portion of the cartridge case neck of the small caliber cartridge case neck of the small caliber cartridge received in the cartridge chamber projects into the bottom portion of the barrel insert and snugly applies by its outer surface against the cylindrical inner surface of the insert. The surprisingly simple solution ensures the effect aimed at, without requiring any additional technical provisions. The cylindrical portion of the cartridge case neck of the subcaliber cartridge, preferably with an adjacent tapering portion, projects from the cartridge chamber into the bottom portion of the barrel insert. At the discharge, the neck of the cartridge case is so strongly sealingly pressed against the barrel insert that a gastightedness is achieved. This solution further bridges the play between the cartridge chamber and the barrel insert.

A development of the invention provides, as a means for assisting the gastightedness, that a plurality of circumferentially distributed gas bores are provided in the bottom portion of the barrel insert which open into the cylindrical cavity of the insert at locations beyond the cartridge case neck and, at their other side, extend toward the frontal face of the cartridge chamber to open into a frontal annular groove provided in the bottom of the barrel insert and filled with a gasket. This is an option augmenting the tightness by a seal ring. The seal ring or gasket is exposed to the pressure of gases which flow through the gas bores from the bottom portion of the insert after the projectile has separated from the case.

To minimize the gap between the insert bottom and the cartridge chamber, and thus give support to the sealing means, it may be provided that the insert bottom portion is provided with an outer circumferential groove into which a locking ring operatively connected to a firing pin case which is axially introducible into the cartridge chamber, can be forced by pressure.

It may further be provided that the locking ring is operatively engageable with oblique surfaces of locking members which are circumferentially distributed about the insert bottom portion and axially displaceable by thrust pins which extend parallel to the barrel axis and are axially biased and carry angle pieces on their free ends, having radially inwardly projecting legs by which they bear, under the bias of springs, against an axial shoulder provided on the firing pin case and facing the insert bottom. It may also be provided that compression springs surrounding the thrust pins are provided between the angle pieces and an opposite bearing surface of the cartridge chamber.

In a further development, it may be provided that the cartridge chamber is designed as an adapter cartridge inserted in the rear portion of the barrel.

Accordingly it is an object of the invention to provide a gastight seal of a gun barrel which comprises a gun barrel insert in the barrel bore having a bore for firing a cartridge of a smaller caliber and a cartridge case of the smaller caliber positioned in the barrel having a cylindrical case neck portion engaged at the insert bottom portion with an outer surface snugly applied against the cylindrical inner surface of the bore of the insert.

A further object of the invention is to provide a gastight seal of a gun barrel which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

In the drawings:

The only FIGURE of the drawings is a partial sectional view of a gun barrel having an insert for a cartridge of a small caliber constructed in accordance with the invention.

DESCRIPTION OF THE PREFERRED EMBODIMENT

Referring to the drawing in particular the invention embodied therein comprises an insert construction for a gun barrel which is fittable in the barrel bore and which has a bore in a bottom portion of the insert which tightly engages the neck portion of a cartridge of a smaller caliber than the gun barrel bore caliber.

In a barrel 1, a barrel insert 2 is received having a bottom portion 3. Axially adjacent bottom portion 3 at the rear side, an adaptor cartridge 4 is provided which is designed as a cartridge chamber. A firing pin case 5 extending from a breech block 6 at the barrel breech, is axially inserted in adapter cartridge 4. The cylindrical portion of the neck 7 of a case of a subcaliber cartridge 8, projects centrally from adaptor cartridge 4 into bottom portion 3 of barrel insert 2, and fittingly applies by its outer surface against the inside cylindrical surface of the insert. Upon firing cartridge 8, the neck 7 of the cartridge case is pressed so strongly against the inside of the insert that a gastightedness as desired is obtained.

Beyond the cylindrical neck portion 7 of the cartridge case, circumferentially distributed gas bores 9 are provided in insert 2 which, in the radial direction, open into the inside of adapter the insert, and axially extend toward the opposite face 10 of cartridge 4. In this axial direction, gas bores 9 open into an annular groove 11 provided in the bottom of the insert, which groove accommodates a gasket 12. Gasket 12 is exposed to the gas pressure through gas bores 9 after the projectile becomes separated from the case. This pressure presses ring shaped gasket 12 against face 10 of cartridge chamber 4, thereby sealing off the outside. Face 10 is radial with respect to the gun barrel bore axis.

Further, to minimize the gap between bottom 3 of insert 2, and adapter cartridge 4, mutual locking is provided. For this purpose, an annular groove 13 is provided in bottom portion 3 of insert 2 into which a locking ring 15 is engageable by means of oblique surfaces 16 of a locking member 14, to obtain a positive connection between insert 2 and adapter cartridge 4. The locking engagement is started by closing breech block 6 and thus shifting the firing pin case 5, accommodating the striking mechanism 17, axially into adapter cartridge 4. This moves angle pieces 19 which are firmly secured to circumferentially distributed thrust pins 18, forward, in the direction of insert 2.

The radially inwardly extending legs 20 of angle pieces 19 apply against a shoulder 21 of firing pin case 5. Compression springs 23 surrounding thrust pins 18 are provided between angle pieces 19 and an opposite bearing surface 22 of cartridge chamber 4. The axial displacement of firing pin case 5 in the direction of insert bottom 3 moves angle pieces 19 and thus thrust pins 18 axially against locking members 14 which are thereby pushed forward. Through oblique surfaces 16 of locking members 14, locking ring 15 is forced radially into annular groove 13, whereby the locking engagement is accomplished. Upon opening breech block 6, locking members 14 are retracted by compression springs 23 through thrust pins 18. Locking ring 15 expands and disengages from groove 13, thereby unlocking the parts.

While a specific embodiment of the invention has been shown and described in detail to illustrate the application of the principles of the invention, it will be understood that the invention may be embodied otherwise without departing from such principles.

What is claimed is:

1. A gastight seal apparatus for a gun barrel having a barrel bore with a breech, comprising a gun barrel insert disposed in the barrel bore and having an insert bore with an end facing the breech having a cylindrical inner surface, an adapter cartridge having a cartridge chamber and engaged in the barrel bore against the barrel insert, a subcaliber cartridge having a cartridge case disposed in said cartridge chamber, said cartridge case having a cylindrical neck portion extending out of said adapter cartridge into said insert bore and in close association with said inner cylindrical surface of said insert bore whereby when said subcaliber cartridge is fired gases expand said neck to form a seal between an outer surface of the neck and said inner surface of said insert bore, a periphery of said barrel insert being provided with an annular groove, a locking ring disposed in said groove, a striking mechanism engaged in said cartridge chamber between said adapter cartridge and the breech of said gun barrel, a plurality of locking members extending from said striking mechanism toward and around said adapter cartridge and said barrel insert, said locking members being circumferentially spaced and axially displaceable, a thrust pin associated with each of said locking members for displacing said members, said locking members having oblique surfaces engaged with said locking ring, and means axially biasing said locking members into engagement with said ring, said locking members carrying at their inner ends a shoulder which is engageable by said striking mechanism.

2. A gastight seal apparatus for a gun barrel having a barrel bore with a breech, comprising a gun barrel insert disposed in the barrel bore and having an insert bore with an end facing the breech having a cylindrical inner surface, an adapter cartridge having a cartridge chamber and engaged in the barrel bore against the barrel insert, a subcaliber cartridge having a cartridge case disposed in said cartridge chamber, said cartridge case having a cylindrical neck portion extending out of said adapter cartridge into said insert bore and in close association with said inner cylindrical surface of said insert bore whereby when said subcaliber cartridge is fired gases expand said neck to form a seal between an outer surface of the neck and said inner surface of said insert bore, said barrel insert having a bottom portion surrounding said cylindrical inner surface and said insert bore, said bottom portion having a bottom surface, said adapter cartridge having a face engaged against said bottom surface, said bottom portion of said barrel insert having at least one gas bore extending from said cylindrical inner surface at a location adjacent said cylindrical neck portion of said cartridge case, to said bottom surface of said bottom portion, said bottom portion having an annular groove in said bottom surface communicating with said at least one gas bore, a ring-shaped gasket in said annular groove whereby when said subcaliber cartridge is fired, gases pass through said at least one gas bore and into said annular groove to press said gasket against said face of said adapter cartridge, said insert bottom portion being provided with an outer circumferential groove around its periphery, and a locking ring disposed in the groove around the periphery of said bottom portion, a firing pin case between said cartridge chamber and the breech engaged in the cartridge chamber by pressure, said locking ring being operatively connected to said firing pin case.

* * * * *